United States Patent [19]

Wang et al.

[11] Patent Number: 4,862,580

[45] Date of Patent: Sep. 5, 1989

[54] MULTI-PURPOSE MODULAR PLUG CRIMP TOOL

[75] Inventors: Yough J. Wang; Wen L. Shyu, both of Taipei Hsien, Taiwan

[73] Assignee: Dual Enterprises Corporation, Taipei Hsien, Taiwan

[21] Appl. No.: 217,641

[22] Filed: Jul. 12, 1988

[30] Foreign Application Priority Data

Feb. 11, 1988 [TW] Taiwan ..... 77201408

[51] Int. Cl.[4] ..... H01R 43/04

[52] U.S. Cl. ..... 29/566.4; 29/751; 29/758; 29/270; 81/423; 81/DIG. 11

[58] Field of Search ..... 29/751, 750, 758, 270, 29/861, 863, 566.4, 33 M; 81/304, 300, 421, 422, 423, DIG. 11

[56] References Cited

U.S. PATENT DOCUMENTS

| | | | |
|---|---|---|---|
| 4,429,451 | 2/1984 | Angelico | 29/751 X |
| 4,480,374 | 11/1984 | Meyer | 29/751 X |
| 4,713,874 | 12/1987 | Schwartz | 29/751 X |

*Primary Examiner*—Timothy V. Eley
*Attorney, Agent, or Firm*—Charles E. Pfund

[57] ABSTRACT

This invention discloses a multi-purpose modular plug crimp tool which is provided with at least one set of modular plug receiving groove, conduction piece pressing block, bus pressing block etc., and is thus applicable to perform crimp operations for several types of modular plugs.

6 Claims, 5 Drawing Sheets

MULTI-PURPOSE MODULAR PLUG CRIMP TOOL

FIELD OF THE INVENTION

This invention relates to a multi-purpose modular plug crimp tool which is applicable to several modes of modular plugs for crimp operation. The so-called "crimp operation" referred to herein and hereinunder is defined as fixing within a modular plug a bus inserted thereinto and meanwhile pressing downward several juxtaposed conduction pieces protruding outward from the upper surface of the modular plug so as to break the insulation coating of the telephone bus by means of the downward moving conduction pieces and form electrical conduction between the conduction pieces of the modular plug and the telephone bus.

BACKGROUND OF THE INVENTION

It is well-known to those having ordinary skill in the art that common modular plugs are of the types of U.S. series (e.g. U.S. 4p, U.S. 6p and U.S. 8p etc.), and U.K. series (U.K. 6p etc.), wherein the number of "p" designates the number of conduction pieces which can be installed in a modular plug. For example, a 4p modular plug denotes a modular plug in which four conduction pieces can be installed so as to form electrical conduction between the conduction pieces and a four-line bus.

A conventional modular plug crimp tool is usually a single-purpose one which can be applied to only one type of modular plug. Thus, when we have to perform crimp operations for several types of modular plugs, it will be very inconvenient to use conventional modular plug crimp tools, because several crimp tools will be necessary.

An example for a conventional modular plug crimp tool is shown in FIG. 5. The illustrated modular plug crimp tool 101 is adapted for the crimp operation for a U.S. 4p modular plug 60 and a four-line telephone bus 70. This crimp tool 101 mainly comprises a pair of upper and lower members 102 and 103, with the front ends thereof being pivotably connected to each other by means a pivot pin 106, and with a restoring spring 113 being provided therebetween. A pressing portion 116 and a guide post 115 are integrally formed on and protrude downward from the undersurface of the upper member 102. The guide post 115 in cooperation with a pair of guide holes 114 provided in the upper surface of the lower member 103 for receiving the lower end of the guide post 115 may be used to guide the relative movement of the upper member 102 toward or away from the lower member 103. A receiving groove 104 is formed in the lower member 103 and vertically aligned with the pressing portion 116 of the upper member 102, and opens to one side surface of the lower member 103 to facilitate the insertion of the plug 60 thereinto. A receiving block 105 which is properly configured for receiving the plug 60 is integrally formed within the receiving groove 104. Two through holes 109 and 110 are formed in the top wall of the receiving groove 104 for guiding the vertical movement of a bus pressing block 107 and a conduction piece pressing block 108 which are installed partially through the two through holes 109 and 110, respectively. Both of these two pressing blocks 107 and 108 are supported by a spring 111 secured to the lower member 103 and are vertically aligned with the pressing portion 116. Thus, the pressing block 107 will be pushed downward by the pressing portion 116 when the upper member 102 is moved toward the lower member 103, to force downward a bus pressing piece 63 of the modular plug 60 for securing the bus 70 within the plug 60 by means of an engaging mechanism (not shown) provided in the plug 60, and the pressing block 108 will be pushed downward in a similar manner to force the conduction pieces 62 downward so as to break the insulation coating of the bus 70 and thereby forming electrical conduction between the conduction pieces 62 and the bus 70. Once the downward operating force with respect to the upper member 102 is released, the upper member 102 will restore to its original position under the action of the restoring spring 113 and the two pressing blocks 107 and 108 will also return to their original position under the action of the spring 111 for subsequent use.

As is obvious from the above description, a conventional modular plug such as one shown in FIG. 5 is applicable only to the crimp operation for a single type of modular plug 60 due to the fact that different types of modular plugs have different shapes, sizes and spacing between the bus securing piece and the conduction pieces. Hence, a conventional modular plug is restricted in its use.

SUMMARY OF THE INVENTION

In view of the above-described disadvantage of conventional modular plug crimp tool, this invention intends to provide a multi-purpose modular plug crimp tool adapted for performing crimp operation for various types of modular plugs, each of which has a plurality of juxtaposed conduction pieces partially protruding outward from the upper surface thereof, and corresponding buses inserted thereinto. This multi-purpose modular plug comprises a pair of upper and lower members which are pivotably connected to each other at their front ends and open at their rear ends in a natural state, with at least one pressing portion being integrally formed on the underside of said upper member opposite to said lower member and with at least one insertion groove being formed in said lower member and opening to one side surface thereof; a restoring spring mounted between said upper and lower members for restoring said pair of upper and lower members to the natural opened state after crimping operation has been completed so as to facilitate subsequent operation; at least one conduction piece pressing block provided between said pair of upper and lower members, each of which being located over one of said at least one insertion groove, and being vertically movable and elastically restorable so as to be able to force said conduction pieces of said modular plug downward and break the insulation coating of said bus to form electrical conduction between said bus and said conduction pieces when said pair of upper and lower members are operated to move to each other at their rear ends, and to elastically restore to its original position when said upper and lower members are released; at least one bus pressing block each of which being juxtaposed with one of said at least one conduction piece pressing block along a direction in which said bus is inserted into said modular plug, each of said bus pressing block being vertically movable and elastically restorable so as to be able to press said bus and secure said bus within said modular plug when said upper and lower members are operated to move to each other at their rear ends, and to elastically restore to its original position when said upper and lower members are released; and at least one insertion block each of which can be inserted into one of said at least one insertion groove to form, together with said insertion groove, a space adapted for receiving therein one chosen type of said modular plug and performing the crimping operation thereof.

BRIEF DESCRIPTION OF THE DRAWINGS

This invention can be more fully understood by referring to the following detailed description and accompanying drawings, which form an integral part of this invention.

DETAILED DESCRIPTION OF THE PREFERRED EMBODIMENT

The structure of a modular plug in accordance with a preferred embodiment of this invention will now be described in detail with reference to the accompanying drawings.

Figure 1:
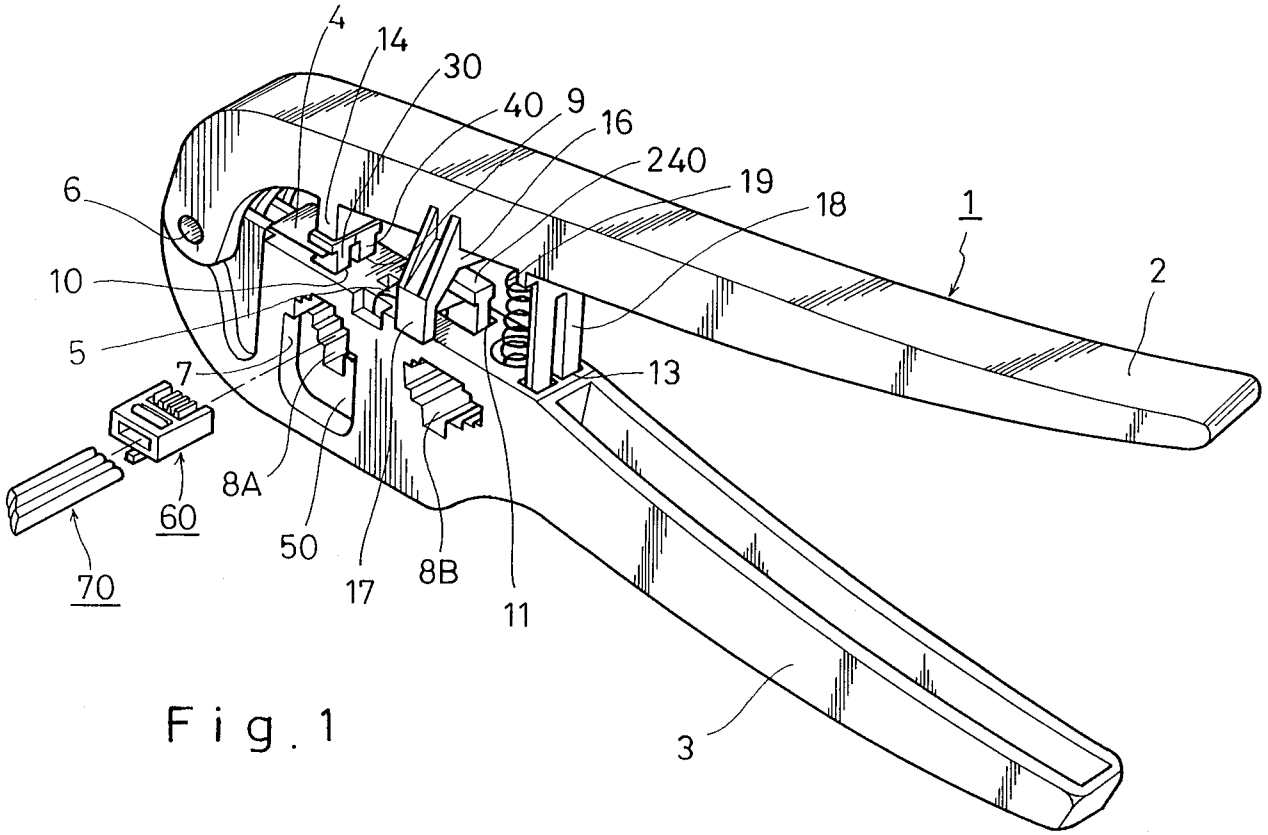
FIG. 1 is a perspective view of a multi-purpose modular plug crimp tool in accordance with a preferred embodiment of this invention, in which the way an insertion block, a modular plug and then a bus are inserted for crimp operations is also shown.

Referring now to FIG. 1, the modular plug crimp tool 1 of this invention mainly comprises a pair of upper and lower members 2 and 3 pivotably connected to each other by means of a pin 6, with a restoring spring 19 being provided between the upper and lower members 2 and 3. Besides, an integrally formed guide post 18 protrudes downward from the undersurface of the upper member 2, and a pair of guide holes 13 corresponding to the guide post 18 are provided on the upper surface of the lower member 3 for receiving the lower end of the guide post 18 so as to guide the movement of the upper member 2 toward or away from the lower member 3. In addition, a first pressing portion 14 and a second pressing portion 16 are also integrally formed on the undersurface of the upper member 2 with a portion of the second pressing portion 16 being further extended sideward and downward so as to form an integral second bus pressing block 17.

An insertion hole 7 and a second receiving groove 8B vertically aligned, respectively, with the first pressing portion 14 and the second pressing portion 16 of the upper member 2 are formed in the lower member 3 and open to one side surface of the lower member 3. The second receiving groove 8B is adapted for receiving a U.S. 8p modular plug 260 or U.K. 6p modular plug 360 (see FIGS. 4(A) and 4(B) therein for performing crimp operation. An insertion block such as the insertion block 50 as shown in FIG. 2(C) or the insertion block 150 as shown in FIG. 3(C) can be inserted into the insertion hole 7 so as to form, in cooperation with the insertion hole 7, a first receiving groove 8A for receiving a U.S. 4p modular plug 60 or U.S. 6p modular plug 160 (see FIGS. 2(D) and 3(D) therein for subsequent crimp operation. Two vertical through holes 9 and 10 aligned along the insertion direction of a modular plug are formed in the top wall of the insertion hole 7. The through hole 10 is provided for guiding the vertical movement of a first bus pressing block 30 (see FIG. 2(A) or 3(A) which is slidably provided therethrough and can be used in the crimp operation for U.S. 4p modular plug 60 or U.S. 6p modular plug 160 in a similar manner as described above. The through hole 9 is provided for optionally guiding the vertical movement of a first conduction piece pressing block 40 or 140 (see FIG. 2(B) and FIG. 3(B)). Both these two pressing blocks 30 and 40 (or 140) are supported by a spring 4 secured to the lower member 3 and are located under the first pressing portion 14. Another vertical through hole 11 is provided in the top wall of the second receiving groove 8B for guiding the vertical movement of a second conduction piece pressing block 240 which is slidably provided therethrough and is aligned with the above-mentioned second bus pressing portion 17 along the insertion direction of a modular plug into the second receiving groove. The second conduction piece pressing block 240 is supported by a spring 5 secured to the lower member 3. Thus, when the upper member 2 is moved toward the lower member 3, the first pair of pressing blocks 30 and 40 will be pushed downward by the first pressing portion 14, meanwhile the second conduction piece pressing block 240 will be pushed downward, together with the downward movement of the second conduction piece pressing block 17, by the second pressing portion 16. Consequently, the downward moving first or second pair of pressing block 30, 40 or 240, 17 can perform crimp operation for a U.S. 4p or U.S. 6p modular plug inserted into the first receiving groove 8A, or for a U.S. 8p or U.K. 6p modular plug inserted into the second receiving groove 8B in a similar manner as described above with respect to a conventional modular plug crimp tool. The functions for the springs 4, 5 and 19 are similar to the corresponding parts in a conventional modular plug crimp tool and thus the description thereof is omitted here.

Figure 2B:
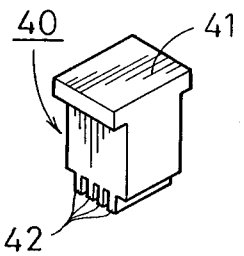
FIGS. 2(A) through 2(C) are, respectively, the perspective views for a bus pressing block, a conduction piece and an insertion block used for the crimp operation between a U.S. 4p modular plug and a corresponding bus, and FIG. 2(*d*) is a perspective view for a U.S. 4p modular plug and a corresponding bus to be inserted thereinto.
Figure 2C:
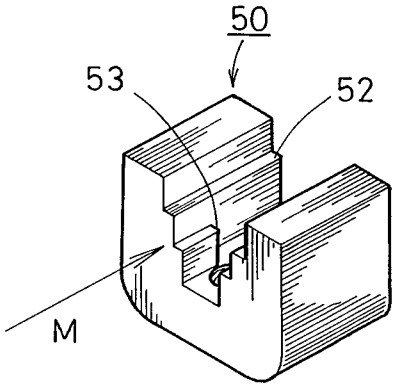
Figure 2A:
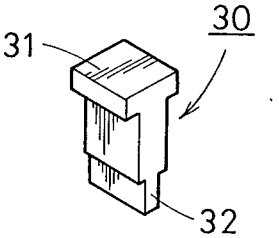
Figure 2D:
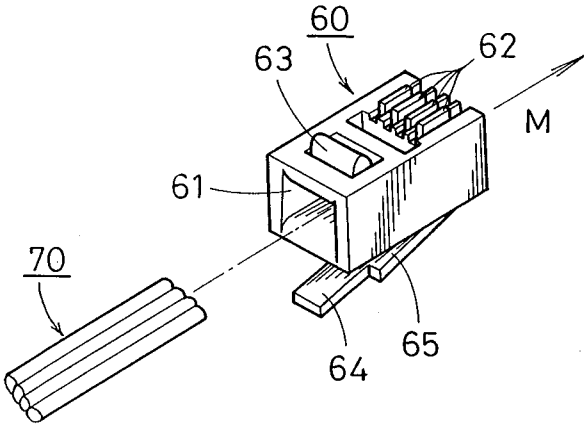
Figure 3A:
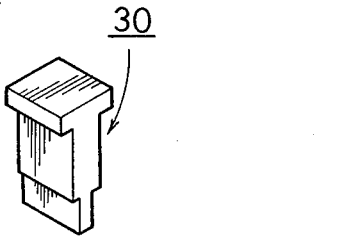
FIGS. 3(*a*) through 3(D) are similar to FIGS. 2(A) through 2(D), except that the situation for U.S. 6p, rather than U.S. 4p, modular plug is shown.

The detailed constructions of the bus pressing block 30, the conduction piece pressing block 40 and the insertion block 50 for the crimp operation of U.S. 4p modular plug 60 are shown in FIGS. 2(A) through 2(C), and the modular plug 60 per se together with its corresponding bus 70 is shown in FIG. 2(D).

The way of performing crimp operation by means of a modular plug crimp tool in accordance with this invention will now be described, taking the case of U.S. 4p modular plug 60 and corresponding bus 70 as an example. At first, the insertion block 50 is inserted into the insertion hole 7 (also refer to FIG. 1), and secured therein with a set screw (not shown). Then, the modular plug 60 is inserted into the first receiving groove 8A formed in the insertion hole 7 above the insertion block 50 along the arrow M direction in FIG. 2. The undersurface of the plug 60 is supported by a supporting surfaces 52 formed in the insertion block 50, and each shoulder portion 65 of an elastic portion 65 formed on the undersurface of the plug 60 is urged against a stop portion 53 formed in the insertion block 50 so as to prevent the plug 60 from moving during a crimp operation.

As is described above and clearly shown in FIG. 2(D), the plug 60 includes four juxtaposed conduction pieces 62 partially protruding upward from the upper surface of the plug 60, and a bus pressing piece 63. The bus pressing block 30 comprises a top portion 31 and a bottom portion 32. The conduction piece pressing block 40 comprises a top portion 41 and four parallel pressing ribs 42 each corresponding to one conduction piece 62. When the insertion block 50 is secured in the insertion hole 7 and the plug 60 is inserted into the receiving groove 8A, the bottom portion 32 is vertically aligned with the bus pressing piece 63 and each of the four pressing ribs 42 is vertically aligned with a conduction piece 62. Under this situation, the corresponding bus 70 is inserted into the receiving hole 61 of the plug 60, and the first pressing portion 14 is moved downward together with the downward movement of the upper member 2 so as to force the two pressing blocks 30 and 40 downward simultaneously by pressing against top portions 31, 41 thereof. The downward moving pressing block 30 forces the conduction pieces 62 downward to break the insulation coating of the bus 70 so as to form electrical conduction between the bus 70 and the conduction pieces 62. The downward moving pressing block 40 forces the bus pressing piece 63 downward so as to press and secure the bus 70 within the modular plug 60. Thus, the crimp operation of the modular plug 60 is completed.

Figure 3B:
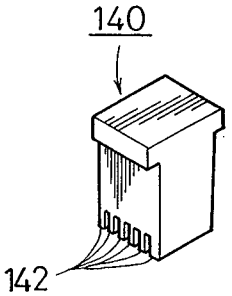
Figure 3C:
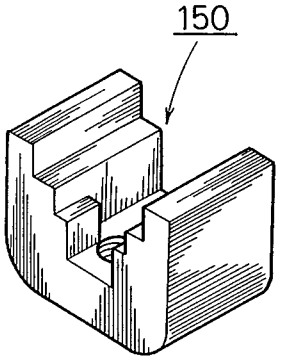
Figure 3D:
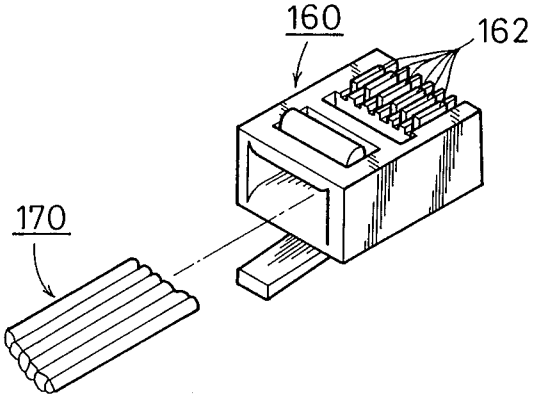

The crimp operation for a U.S. 6p modular plug 160 and a corresponding 6-line bus 170 can be performed in a similar manner but a conduction piece pressing block 140 and an insertion block 150 as shown in FIGS. 3(B) and 3(C) are used instead of the above-described equivalent parts 40 and 50 as shown in FIGS. 2(B) and 2(C). The pressing block 140 is provided with six parallel pressing ribs 142 at its bottom portion, each pressing piece 142 corresponding to one conduction piece 162 of the modular plug 160 and to one of the six telephone lines in the bus 170. The bus pressing block 30 utilized in this case is exactly the same as that used in the above-described U.S. 4p case.

Figure 4B:
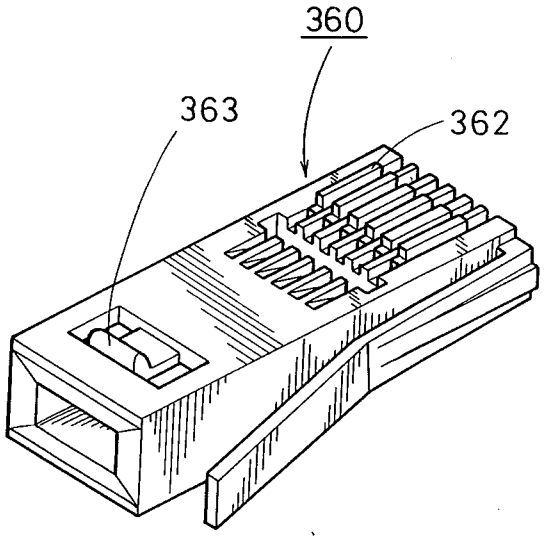
FIGS. 4(A) and 4 (B) are, respectively, the perspective views for a U.S. 8p modular plug and a U.K. 6p modular plug.
Figure 4A:
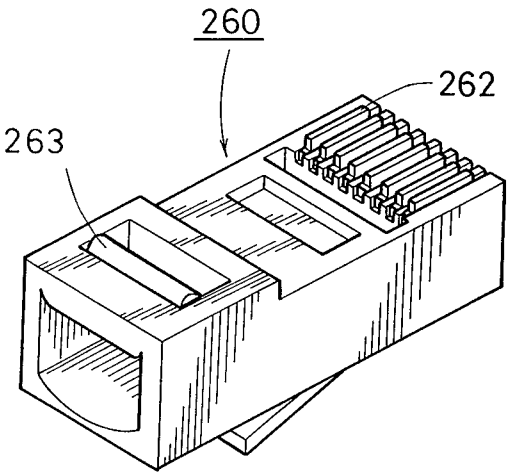
Figure 5:
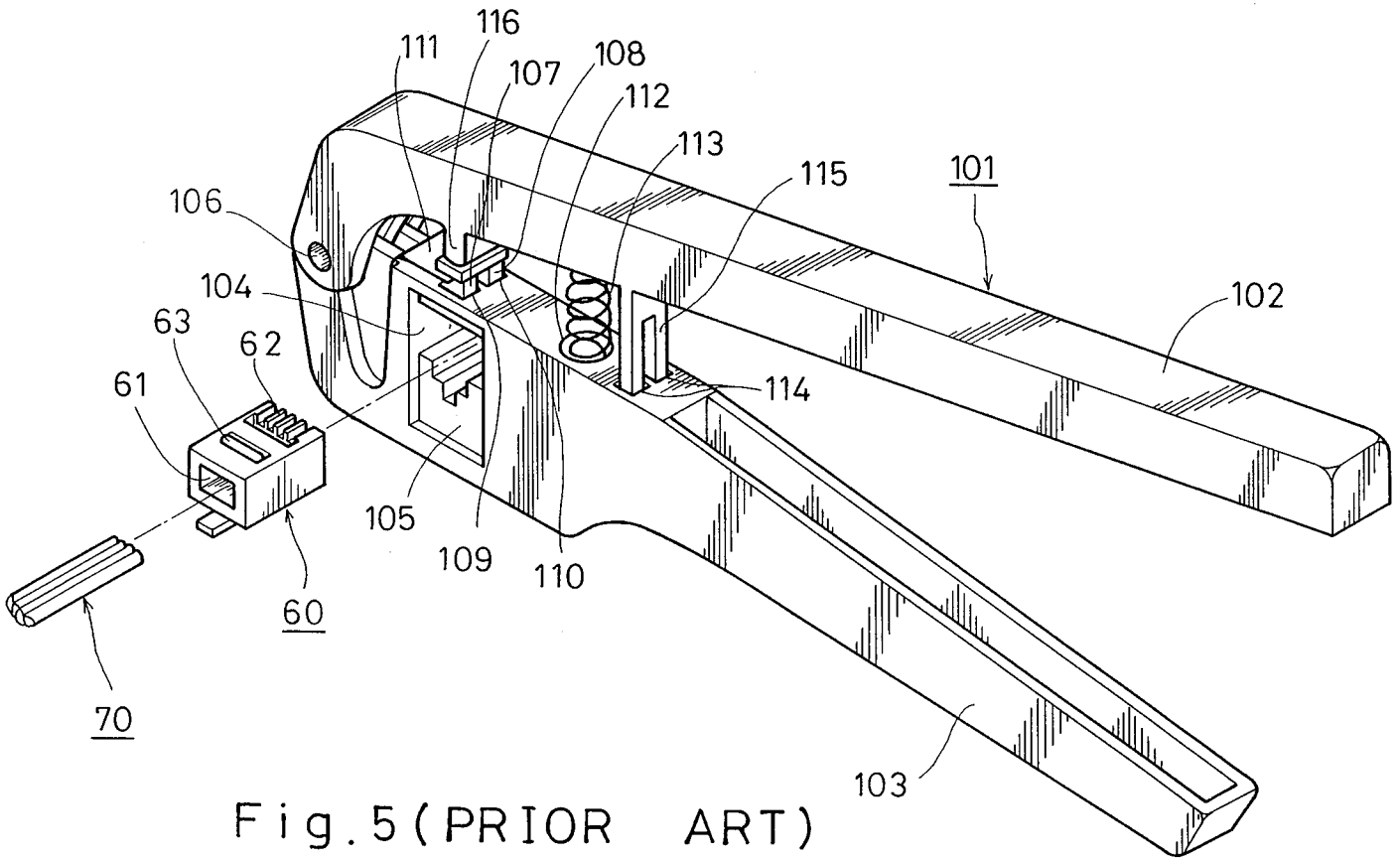
Fig. 5 (PRIOR ART)

The constructions for a U.S. 8p and a U.K. 6p modular plugs 260 and 360 are shown in FIGS. 4(A) and 4(B). In these two cases, the crimp operation can be completed in a similar manner by utilizing the second pressing portion 16, the second pair of conduction piece pressing block 240 and bus pressing block 17, and the second receiving groove 8B, instead of utilizing the first pressing portion 14, the first pair of conduction piece pressing block 40 and bus pressing block 30, and the first receiving groove 9A. Since the spacing between the conduction pieces 262 (or 362) and the bus pressing piece 263 (or 363) is larger than that for the above-described U.S. 4p and U.S. 6p cases, the corresponding spacing between the second pair of pressing blocks 17 and 240 must be larger than that for the first pair of pressing blocks 30 and 40.

In addition to crimp operations for the afore-mentioned U.S. 4p, U.S. 6p, U.S. 8p and U.K. 6p cases, the modular plug crimp tool in accordance with this invention can also be applied, after slight modification in the construction of the insertion block 50, to the case of a so-called U.S. 6p' modular plug which has substantially the same construction as a U.S. 6p modular plug except that the elastic portion 164 is not located at the central portion of the undersurface of the modular plug as is the case of a U.S. 6p modular plug.

While this invention has been described in terms of a preferred embodiment, it is to be understood that this invention need not be limited to the disclosed embodiment. On the contrary, it is intended to cover various modifications and similar arrangements included within the spirit and scope of the appended claims, the scope of which should be accorded the broadest interpretation so as to encompass all such modifications and similar structures.

What is claimed is:

1. A modular plug crimp tool adapted for performing crimp operation for a modular plug and corresponding telephone bus; said modular plug including an upper surface, a plurality of juxtaposed conduction pieces partially protruding outward from said upper surface, and a receiving hole into which said telephone bus to be electrically conducted to said conduction pieces is inserted; said telephone bus including insulation coating coated therearound; said modular plug crimp tool comprising:

a pair of upper member and lower member each of which includes a front end and a rear end, with said front ends of said upper member and lower member being pivotably connected to each other; said rear ends of said upper member and lower member being moveable relative to each other between a non-operative state in which said rear ends are separate from each other and an operative in which said rear ends are close to each other; said upper member having an undersurface, opposite to said lower member, and a plurality of pressing portions integrally formed on said undersurface; and said lower member having a side surface and a plurality of insertion holes opening to said side surface;

a restoring spring mounted between said upper and lower members for restoring said upper and lower members to said non-operative state after crimp operation has been completed so as to facilitate subsequent operation;

a plurality of conduction piece pressing blocks provided between said pair of upper and lower members, each of said conduction piece pressing blocks being supported over one of said insertion holes in a vertically moveable and elastically restorable manner so as to be able to access and force downward said conduction pieces of said modular plug for breaking said insulation coating of said telephone bus and thereby forming electrical conduction between said telephone bus and said conduction pieces in said operative state; and each of said conduction piece pressing blocks being able to elastically restore to its original position in said non-operative state;

a plurality of bus pressing blocks each of which is supported in a vertically movable and elastically restorable manner so as to be able to press said telephone bus and secure said telephone bus within siad modular plug in said operative state; and each of said bus pressing blocks being able to elastically restore to its original position in said non-operative state;

a plurality of insertion blocks each of which can be provided within one of said purality of insertion holes to form, in cooperation with said insertion hole, a receiving groove adapted for receiving therein said modular plug for performing crimp operation thereof;

whereby said modular plug crimp tool is adapted for performing crimp operation for at least two types of modular plugs and corresponding telephone buses.

2. A modular plug crimp tool as described in claim 1, wherein at least one of said plurality of insertion blocks is integrally formed in one of said plurality of insertion holes.

3. A modular plug crimp tool as described in claim 1, wherein at least one of said plurality of bus pressing blocks is integrally formed within one of said plurality of pressing portions.

4. A modular plug crimp tool as described in claim 1, wherein at least one of said plurality of conduction piece pressing blocks is integrally formed with one of said plurality of pressing portions.

5. A modular plug crimp tool as described in claim 1, wherein;

said plurality of pressing portions integrally formed on said upper member comprise a first pressing portion and a second pressing portion;

said plurality of insertion holes comprise a first insertion hole and a second insertion hole.

said plurality of insertion blocks comprise a first insertion block which is adapted for being inserted into said first insertion hole to form, in cooperation with said first insertion hole, a first receiving groove for receiving and engaging a U.S. 4p or U.S. 6p modular plug therein for performing crimp operation, and is changeable depending on the type of modular plug to be performed a crimp operation; and a second insertion block integrally formed within said second insertion hole so as to form a second receiving groove within said second insertion hole for receiving and engaging a U.S. 8p or a U.K. 6p modular plug therein;

said plurality of conduction piece pressing blocks comprise a first conduction piece pressing block and a second conduction piece pressing block; said first conduction piece pressing block being changeable depending on the type of modular plug to be performed a crimp operation, and being supported in a vertically moveable and elastically restorable manner over said first receiving hole; and said second conduction piece pressing block being supported in a vertically moveable and elastically restorable manner over said second receiving hole;

said plurality of bus pressing blocks comprise a first bus pressing block which is supported in a vertically moveable and elastically restorable manner over said first receiving groove; and a second bus pressing block integrally formed with said second pressing portion of said upper member.

6. A modular plug crimp tool as described in any of claims 1 to 5, further comprising a guide means for guiding the movement of said pair of upper member and lower member between said operative state and said non-operative state.

* * * * *